US012410939B2

(12) United States Patent
Jang et al.

(10) Patent No.: US 12,410,939 B2
(45) Date of Patent: Sep. 9, 2025

(54) AIR CONDITIONER

(71) Applicant: LG ELECTRONICS INC., Seoul (KR)

(72) Inventors: Ji Hyun Jang, Seoul (KR); Donghwal Lee, Seoul (KR); Bohee Park, Seoul (KR); Sungho Seo, Seoul (KR); Hyunjin Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 303 days.

(21) Appl. No.: 17/173,284

(22) Filed: Feb. 11, 2021

(65) Prior Publication Data

US 2021/0262691 A1 Aug. 26, 2021

(30) Foreign Application Priority Data

Feb. 20, 2020 (KR) ..... 10-2020-0020926

(51) Int. Cl.

| | |
|---|---|
| ***F24F 11/89*** | (2018.01) |
| ***F24F 1/027*** | (2019.01) |
| ***F24F 1/029*** | (2019.01) |
| ***F24F 1/0323*** | (2019.01) |
| ***F24F 11/52*** | (2018.01) |
| ***F24F 13/20*** | (2006.01) |

(52) U.S. Cl.

CPC ..... *F24F 11/89* (2018.01); *F24F 1/027* (2013.01); *F24F 1/029* (2019.02); *F24F 1/0323* (2019.02); *F24F 11/52* (2018.01); *F24F 13/20* (2013.01); *F24F 2013/207* (2013.01); *F24F 2221/20* (2013.01)

(58) Field of Classification Search

CPC ..... F24F 2013/207; F24F 1/027; F24F 1/029; F24F 11/89; H05K 7/20145; H05K 7/20136

See application file for complete search history.

(56) References Cited

U.S. PATENT DOCUMENTS

2011/0266229 A1* 11/2011 Elwany ..... H05K 7/20736 211/26
2016/0252260 A1 9/2016 Jewell et al.
2019/0003732 A1* 1/2019 Seo ..... F24F 1/027

FOREIGN PATENT DOCUMENTS

KR 10-2009-0031133 3/2009
KR 10-2019-0010240 1/2019

OTHER PUBLICATIONS

Korean Office Action issued in Application No. 10-2020-0020926 dated Jul. 12, 2021.

* cited by examiner

*Primary Examiner* — Schyler S Sanks
(74) *Attorney, Agent, or Firm* — KED & ASSOCIATES, LLP

(57) ABSTRACT

An air conditioner is provided, in which a control box is disposed at a boundary between an indoor main body configured to blow indoor air and an outdoor main body configured to blow outdoor air, and the outdoor air may be introduced into the control box. Accordingly, even if it rains, the air conditioner may prevent direct exposure of the control box and/or a heat sink of the control box to rainwater and facilitate heat dissipation of control components disposed in the control box configured to perform inverter control.

20 Claims, 7 Drawing Sheets

AIR CONDITIONER

CROSS-REFERENCE TO RELATED APPLICATION(S)

This application claims priority to and the benefit of Korean Patent Application No. 10-2020-0020926, filed in Korea on Feb. 20, 2020, the disclosure of which is incorporated herein by reference in its entirety.

BACKGROUND

1. Field

An air conditioner is disclosed herein.

2. Background

Air conditioners may cool, heat, or purify air in a target space, or perform a humidification operation or a dehumidification operation on the target space. The air conditioner may include a compressor, a condenser, an expansion device, and an evaporator to cool the air in the target space, and the compressor, the condenser, the expansion device, and the evaporator are sequentially connected to a pipe. Refrigerant may circulate in the compressor, the condenser, the expansion device, and the evaporator through the pipe.

Air conditioners may include split-type air conditioners and integrated-type air conditioners. The split-type air conditioner may include an indoor unit located in an indoor space to discharge conditioned air into an indoor space and an outdoor unit connected to the indoor unit through a pipe and located in an outdoor space. The indoor unit may include an indoor heat exchanger and the outdoor unit may include an outdoor heat exchanger. When the split-type air conditioner performs a cooling operation, the outdoor heat exchanger may function as a condenser and the indoor heat exchanger may function as an evaporator. When the split-type air conditioner performs a heating operation, the indoor heat exchanger may function as the condenser and the outdoor heat exchanger may function as the evaporator.

For the integrated-type air conditioner, the condenser and the evaporator are accommodated together in a case. The condenser is disposed in an outdoor portion of the case to exchange heat with outside air and the evaporator is disposed in an indoor portion of the case to exchange heat with indoor air.

Korean Patent Publication No. 10-2019-0010240 (hereinafter, "related art document 1"), which is hereby incorporated by reference, discloses an integrated-type air conditioner. For the air conditioner according to related art document 1, a heat sink may be placed on a main printed circuit board (PCB) of a control box, may be exposed to an outside of the control box, and the control box may be disposed in an outdoor space to dissipate heat generated from components mounted on the main PCB of the control box, thereby preventing overheating of the components or the substrate. According to the related art document 1, the control box is located in the outdoor space for heat dissipation. Accordingly, if it rains, the heat sink may be directly exposed to rainwater, thereby degrading insulation performance.

BRIEF DESCRIPTION OF THE DRAWINGS

Embodiments will be described in detail with reference to the following drawings in which like reference numerals refer to like elements, and wherein.

DETAILED DESCRIPTION

Figure 1:
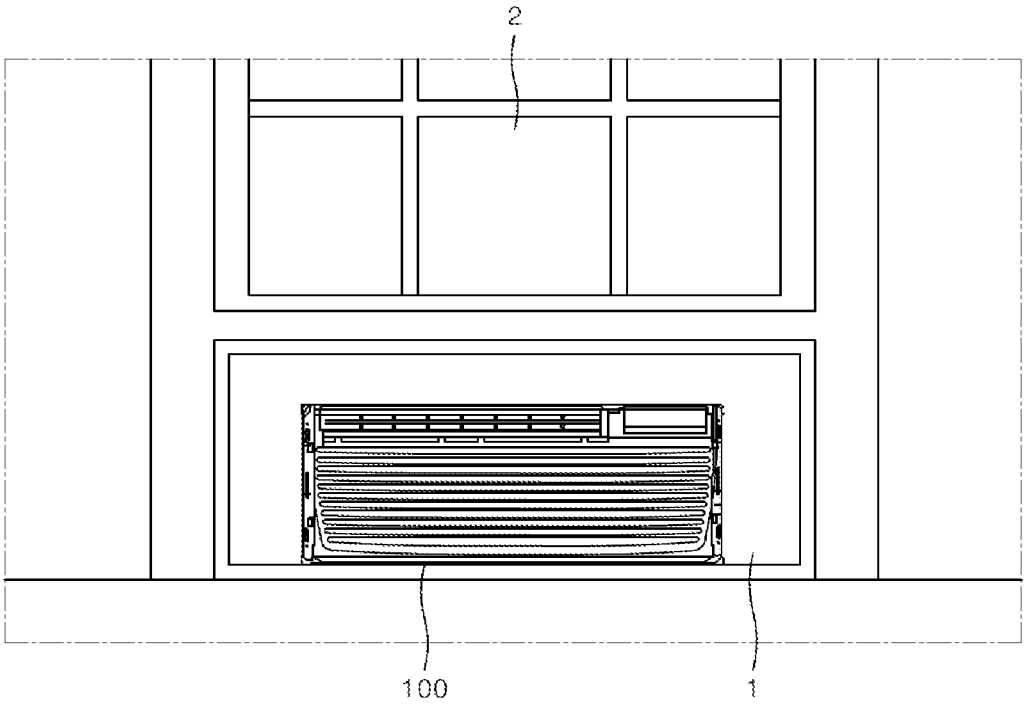
FIG. 1 shows an example of an air conditioner located in a wall.

Embodiments will be described with reference to the accompanying drawings, such that a person having ordinary knowledge in the art to which the embodiments pertain may easily implement the technical idea. Description of well-known technology relating to embodiments may be omitted if it unnecessarily obscures the gist. One or more embodiments are described with reference to the accompanying drawings. The same or like reference numerals may be used to refer to the same or like components.

It will be understood that, although the terms "first", "second", and the like may be used herein to describe various components, however, these components should not be limited by these terms. These terms are only used to distinguish one component from another component. Thus, a first component may be a second component unless otherwise stated.

In this document, the terms "upper," "lower," "on," "under," or the like are used such that, where a first component is arranged at "an upper portion" or "a lower portion" of a second component, the first component may be arranged in contact with the upper surface or the lower surface of the second component, or another component may be disposed between the first component and the second component. Similarly, where a first component is arranged on or under a second component, the first component may be arranged directly on or under (in contact with) the second component, or one or more other components may be disposed between the first component and the second component.

Further, the terms "connected," "coupled," or the like are used such that, where a first component is connected or coupled to a second component, the first component may be directly connected or able to be connected to the second component, or one or more additional components may be disposed between the first and second components, or the first and second components may be connected or coupled through one or more additional components.

Unless otherwise stated, each component may be singular or plural throughout the disclosure.

In some examples, singular expressions used include plural expressions unless the context clearly indicates otherwise. Terms such as "including" or "comprising" should not be construed as necessarily including all of the various components, or various steps described in the present disclosure, and terms such as "including" or "comprising" should be construed as not including some elements or some steps or further including additional elements or steps.

Unless otherwise stated, "A and/or B" means A, B or A and B. Unless otherwise stated, "C to D" means "C or more and D or less".

Hereinafter, an air conditioner and a method for controlling the air conditioner according to embodiments are described.

FIG. 1 shows an example of an air conditioner 100. As shown in FIG. 1, the air conditioner 100 according to an embodiment may be an integrated-type air conditioner. In this structure, a condenser and an evaporator of the air conditioner 100 according to an embodiment may each be accommodated inside of a case. The condenser may be disposed in an outdoor space to exchange heat with outside air and the evaporator may be disposed in an indoor space to exchange heat with indoor air.

As shown in FIG. 1, a building has a wall 1 and a window 2, and the wall 1 may include a hole, that is, an installation space. The air conditioner 100 according to an embodiment may be placed in the hole, that is, in the installation space of the wall 1. In contrast to FIG. 1, the air conditioner 100 according to an embodiment may be placed in an installation space provided in an area where the window 2 is located.

Figure 2:
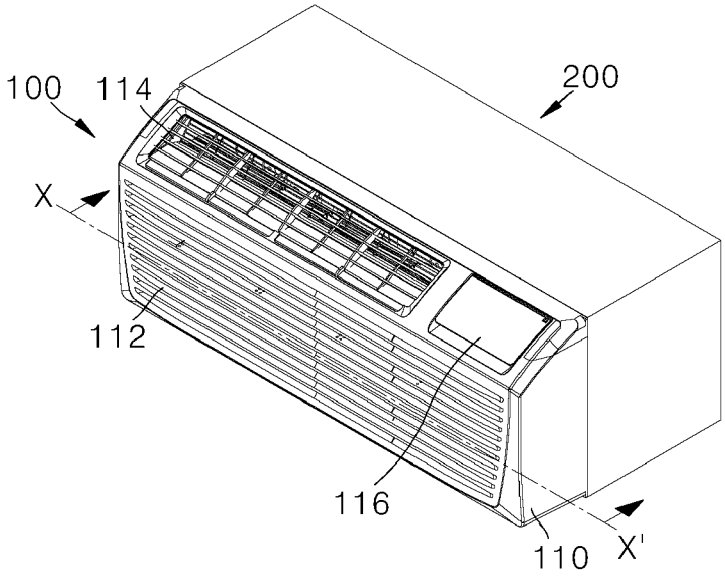
FIG. 2 is a schematic perspective view of an air conditioner according to an embodiment in a case.

FIG. 2 is a schematic perspective view of air conditioner 100 inserted into a case 200. The air conditioner 100 may be inserted into the case 200 through a front surface of the case 200 and may be fixed into the case 200. Hereinafter, a forward direction or a front surface refers to a direction toward the indoor space or a surface in that direction with respect to the wall 1 (see FIG. 1) or the window 2 (see FIG. 1) and a rearward direction or a rear surface refers to a direction toward a side opposite to the indoor space, that is, an outdoor space or a surface in that direction with respect to the wall 1 (see FIG. 1) or the window 2 (see FIG. 1).

The case 200 may have a hexahedral shape and a front portion defining an opening and may include an inner space. The case 200 may define at least one opening to suction and/or discharge air on a rear surface thereof. In addition, the case 200 may be fixed to the installation space of the air conditioner. The case 200 may be disposed in the installation space of the air conditioner in advance or may be provided to the user with the air conditioner 100.

The air conditioner 100 may include a front panel 110. The front panel 110 may include an indoor suction inlet 112 through which indoor air may be suctioned on a front surface thereof and an indoor discharge outlet 114 through which conditioned air may be discharged at an upper portion thereof. The air suctioned through the indoor suction inlet 112 may be heat-exchanged while passing through a main body of the air conditioner 100 and then discharged through the indoor discharge outlet 114.

The front panel 110 may include an interface opening 116 at an upper portion thereof. A display of a control box may be exposed through the interface opening 116, may indicate operation information of the air conditioner, and may also receive an input of a user operation command and/or a user-desired temperature.

Figure 3:
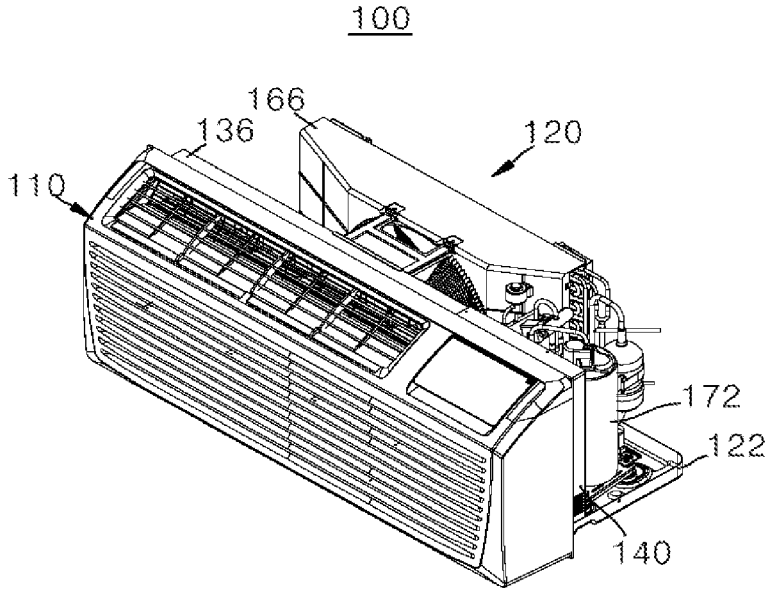
FIG. 3 is a schematic perspective view of the air conditioner of FIG. 2, when viewed from the front.
Figure 4:
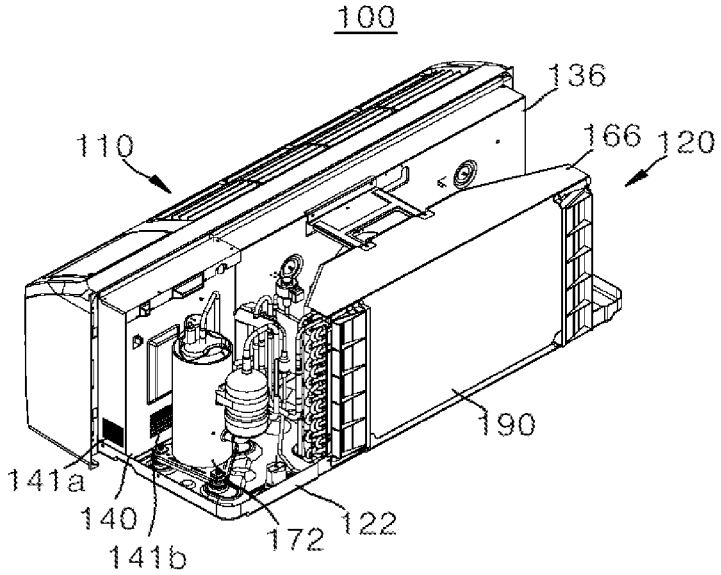
FIG. 4 is a schematic perspective view of the air conditioner of FIG. 2, when viewed from the rear.

FIG. 3 is a schematic perspective view of air conditioner 100, viewed from the front. FIG. 4 is a perspective view of air conditioner 100, viewed from the rear.

The air conditioner 100 according to an embodiment may include a front panel 110 and a main body 120. The main body 120 may include a base 122, an indoor main body disposed on the base 122, and an outdoor main body disposed on the base 122. The front panel 110 of the air conditioner 100 in FIGS. 3 and 4 may be the same as described with respect to FIG. 2.

The main body 120 may include base 122 and a plurality of components disposed on the base 122. The plurality of components may include the indoor main body and the outdoor main body. The plurality of components may include a barrier assembly 136, a control box 140, a shroud 166, a compressor 172, and a condenser 190. The main body 120 may be detachably coupled to the case 200. Accordingly, the main body 120 may be separated from the case 200 for replacement or repair of components.

As shown in FIG. 4, the control box 140 may define an air suction inlet 141*a* at a side thereof and an air discharge outlet 141*b* on a rear surface thereof. The control box 140 may be disposed at a boundary line between the indoor main body and the outdoor main body and define the air suction inlet 141*a* and the air discharge outlet 141*b* to prevent a possibility of penetration of rainwater into the control box 140 and circulate outdoor air in the control box 140.

Detailed functions and arrangements of components of the air conditioner 100 shown in FIGS. 3 and 4 are described hereinafter with reference to FIG. 5.

Figure 5:
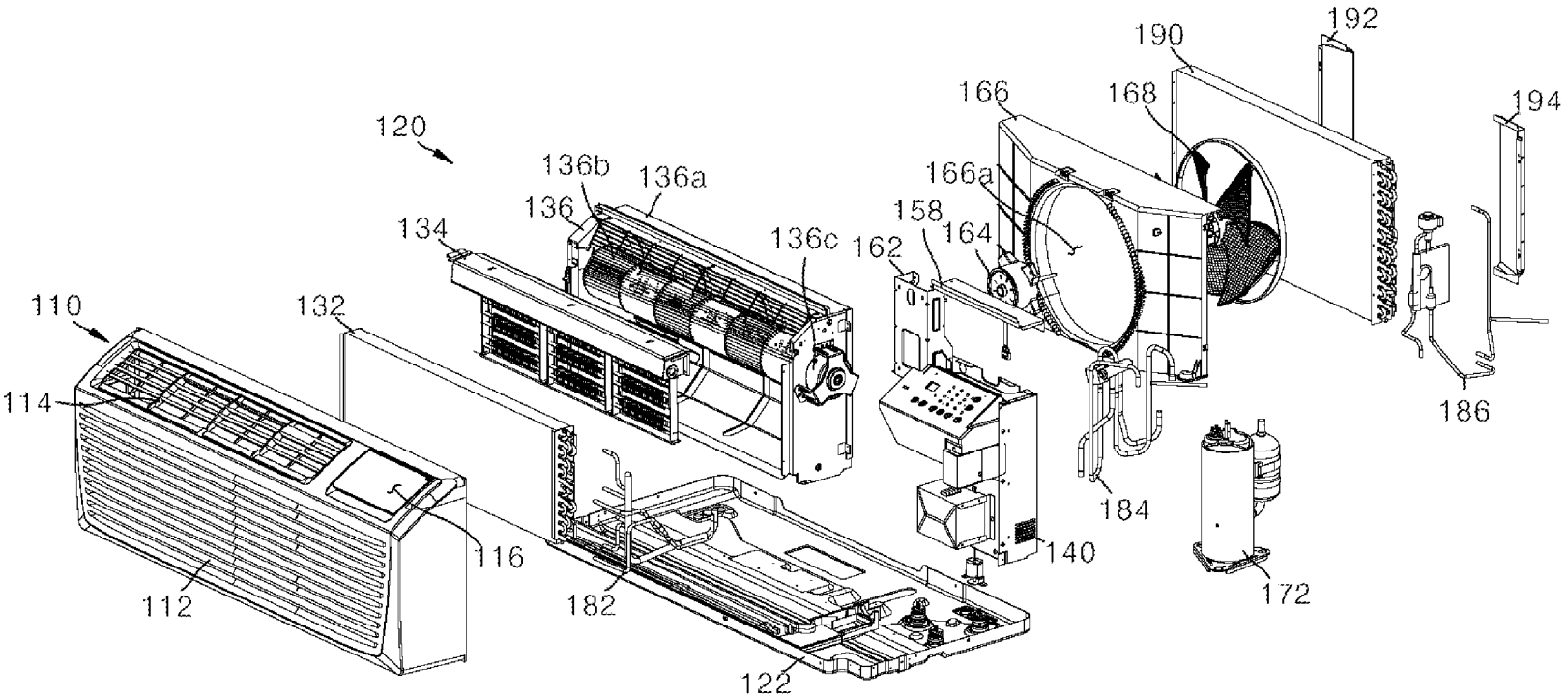
FIG. 5 is a schematic exploded perspective view of the air conditioner of FIG. 2.

FIG. 5 is a schematic exploded perspective view of air conditioner 100. The air conditioner 100 according to an embodiment may include front panel 110 and main body 120. The main body 120 may include base 122, an evaporator 132, a heater 134, barrier assembly 136, control box 140, a control box cover 158, a motor bracket 162, a condenser fan motor 164, shroud 166, a condenser fan 168, compressor 172, a plurality of pipes 182, 184, and 186, condenser 190, and rear grills 192 and 194.

The front panel 110 may be the same as described with respect to FIG. 2. The main body 120 may include base 122, the indoor main body, and the outdoor main body. The barrier assembly 136 and the control box 140 may both be disposed at a boundary between the outdoor main body and the indoor main body. A rear surface of the barrier assembly 136 and a main substrate inside of the control box 140 may form a boundary between the outdoor main body and the main indoor body, components disposed in front of the rear surface of the barrier assembly 136 and the main substrate inside of the control box 140 may constitute the indoor main body, and components disposed behind the rear surface of the barrier assembly 136 and the main substrate inside of the control box 140 may constitute the outdoor main body.

The evaporator 132 may be disposed on an inner surface of the front panel 110. Air suctioned through the indoor suction inlet 112 may pass through the evaporator 132 and be discharged through the indoor discharge outlet 114. Refrigerant condensed by the condenser 190 may be introduced into the evaporator 132 through a third pipe 186. The refrigerant may pass through the evaporator 132 and may be discharged to the compressor 172 through a first pipe 182. The third pipe 186 may include an expansion device configured to decompress the refrigerant condensed by the condenser 190. The air may be suctioned through the indoor suction inlet 112 and may be heat-exchanged with the refrigerant in the evaporator 132 while passing through the evaporator 132. A heater 134 may be disposed on a rear surface of the evaporator 132 to heat the air suctioned through the indoor suction inlet 112.

The barrier assembly 136 may be disposed behind the evaporator 132, that is, on the rear surface of the heater 134 disposed on the rear surface of the evaporator 132, to partition the outdoor main body and the indoor main body. That is, a rear surface 136*a* of the barrier assembly 136 may have a flat plate shape such that an indoor air flow path may be separated from an outdoor air flow path. The barrier assembly 136 may include an evaporator fan 136*b* and an evaporator fan motor 136*c*. The evaporator fan 136*b* and the evaporator fan motor 136*c* may each be disposed in front of the rear surface 136*a* of the barrier assembly 136. The evaporator fan motor 136*c* may rotate the evaporator fan 136*b*. The evaporator fan 136*b* may discharge the air forward, which was introduced from the front. For example, the evaporator fan 136*b* may suction the air that has passed through the evaporator 132 and/or the heater 134 disposed in front of the evaporator fan 136*b* and discharge the suctioned air in a forward direction. The air discharged by the evaporator fan 136*b* may be discharged to the indoor space through the indoor discharge outlet 114.

At least a portion of a front surface of the control box 140 may be disposed on the inner surface of the front panel 110 and the control box 140 may also be disposed at a side surface of the barrier assembly 136. In addition, the control box 140 may be spaced apart from an inner surface of the case 200 (see FIG. 2) by a predetermined distance or more. For example, a distance between a side surface of the case 200 (see FIG. 2) and an inner surface of the control box 140 may be equal to or greater than 15 mm. The control box 140 may control the evaporator fan motor 136*c*, the condenser fan motor 164, and the compressor 172. A configuration of the control box 140 is illustrated in FIGS. 6 to 9.

Control box cover 158 may be disposed on the control box 140 to cover an upper surface of the control box 140.

The motor bracket 162 may be disposed on a front surface of the condenser fan motor 164 to support and fix the condenser fan motor 164.

The condenser fan motor 164 may be disposed between the rear surface of the barrier assembly 136 and the shroud 166. For example, the condenser fan motor 164 may be arranged such that a center of a motor shaft of the condenser fan motor 164 corresponds to a center of a shroud opening 166*a*.

The shroud 166 may be disposed between the barrier assembly 136 and the condenser 190. The shroud 166 may be disposed behind the barrier assembly 136 and may be spaced apart from the barrier assembly 136. In addition, the shroud 166 may be coupled to the condenser 190. The shroud 166 may also be coupled to the condenser fan 168 to guide a flow of air passing through the condenser fan 168. The shroud 166 may include the shroud opening 166*a* to guide air to a suction side of the condenser fan 168. That is, outdoor air introduced into the case 200 (see FIG. 2) may be suctioned into the condenser fan 168 through the shroud opening 166*a*.

The condenser fan 168 may be disposed between the shroud 166 and the condenser 190. The condenser fan 168 may be disposed in a space formed by the shroud 166 in front of the condenser 190. The condenser fan 168 may be coupled to the shroud 166 to suction air through the shroud opening 166*a* and discharge the suctioned air to the condenser 190. That is, the condenser fan 168 may blow outdoor air. The condenser fan 168 may be an axial-flow fan to suction air in an axial direction and discharge the air in the axial direction.

The compressor 172 may be disposed in a space between a rear of the control box 140 and a side of the shroud 166. The compressor 172 may be spaced apart from each of the control box 140 and the shroud 166. A gas-liquid separator may be disposed at one side of the compressor 172. The compressor 172 may be connected to the evaporator 132 through the first pipe 182. The refrigerant discharged from the evaporator 132 may flow into the compressor 172 through the first pipe 182. The compressor 172 may compress the introduced refrigerant and discharge the refrigerant to the condenser 190 through the second pipe 184.

The condenser 190 may be disposed on a rear surface of the shroud 166. The condenser 190 may be coupled to the shroud 166 on the rear surface of the shroud 166. Air discharged from the condenser fan 168 may be discharged to the outdoor space through the condenser 190. Refrigerant discharged from the compressor 172 may flow into the condenser 190 through the second pipe 184. The condenser 190 may condense the introduced refrigerant and discharge the refrigerant to the evaporator 132 through the third pipe 186. Rear grills 192 and 194 may be disposed on a rear surface or both sides of the condenser 190 and guide air that has passed through the condenser 190.

Figure 6:
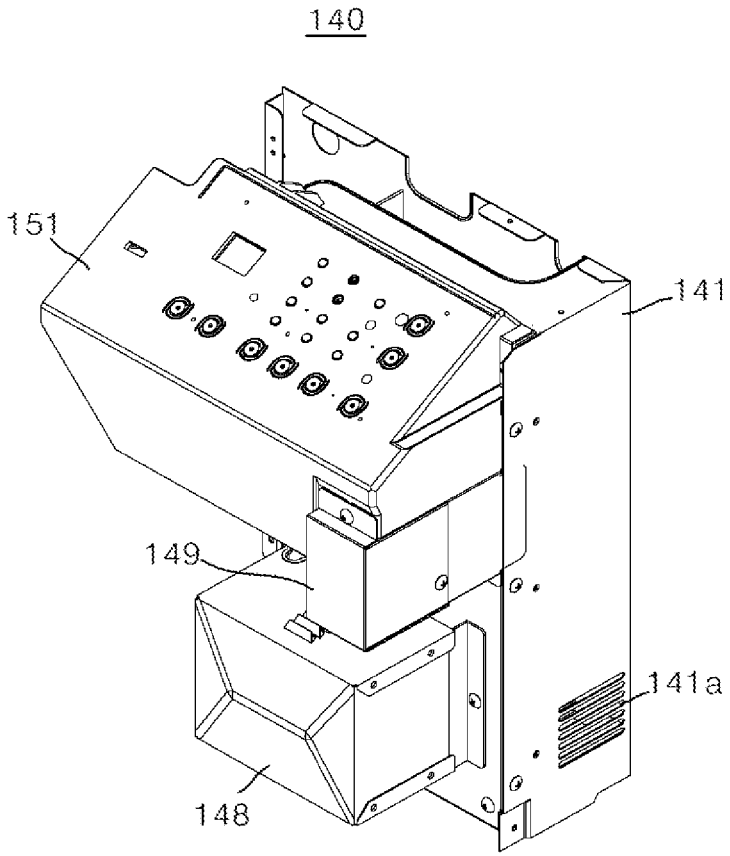
FIG. 6 is a schematic perspective view of a control box of an air conditioner according to an embodiment.

FIG. 6 is a schematic perspective view of control box 140 of air conditioner 100 according to an embodiment. The control box 140 may include a barrier 141, a reactor cover 148, a first power cover 149, and a display cover 151.

At least a portion of the control box 140 may be disposed on an inner side surface of the front panel 110 (see FIGS. 2 and 3). For example, the reactor cover 148, the first power cover 149, and the display cover 151 of the control box 140 may be disposed on the inner side surface of the front panel 110 (see FIGS. 2 and 3). The barrier 141 of the control box 140 may be disposed behind a rear end of the front panel 110 (see FIGS. 2 and 3). In addition, the barrier 141 of the control box 140 may define air suction inlet 141*a* to suction air at a side surface thereof.

Figure 7:
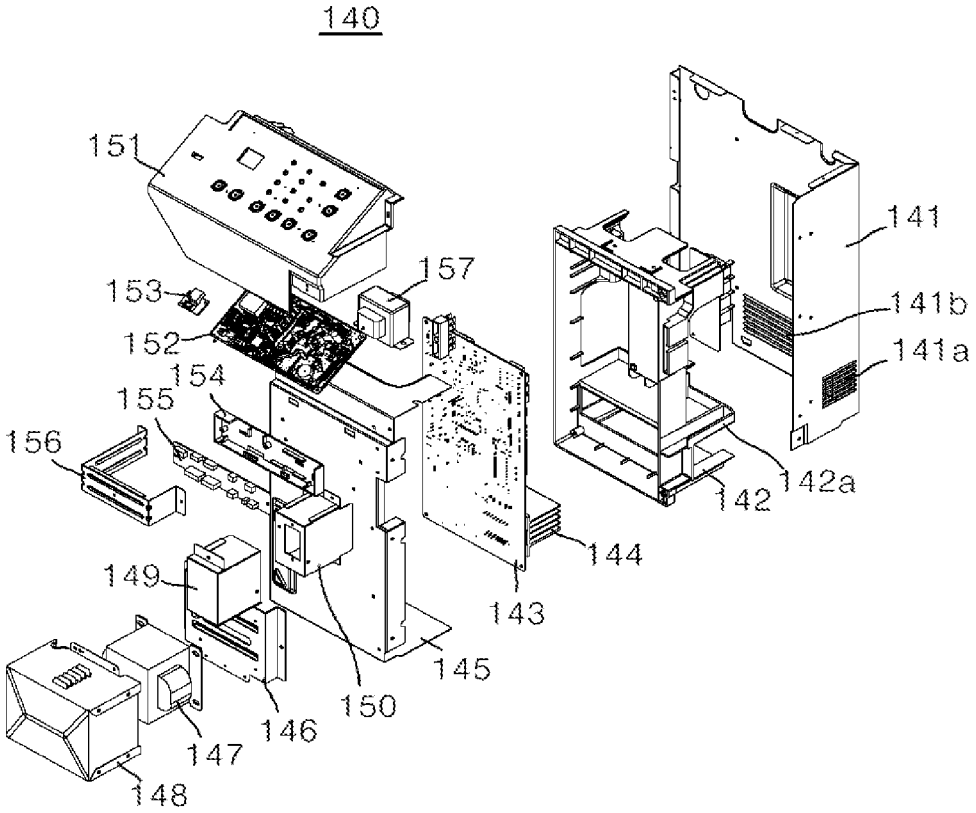
FIG. 7 is a schematic exploded perspective view of the control box of FIG. 6.

FIG. 7 is a schematic exploded perspective view of control box 140 of air conditioner 100 in FIG. 6. The control box 140 may include barrier 141, a control box case 142, a main substrate 143, a heat sink 144, a control box cover 145, a reactor base 146, a reactor 147, reactor cover 148, first power cover 149, a second power cover 150, a display including display cover 151, a display substrate 152, and a communication module 153, a sub cover 154, a sub-substrate 155, a supporter 156, and a transformer 157.

The barrier 141 may define a first side surface and a rear surface of an appearance of the control box 140 and may support and protect other components of the control box 140. The barrier 141 may be made of metal, for example. The barrier 141 may be disposed at a rear surface of the control box case 142 and be coupled to the control box cover 145 to cover the rear surface and the first side surface of the control box case 142. The barrier 141 may define air suction inlet 141*a* through which air is suctioned into the control box 140 and air discharge outlet 141*b* through which air inside of the control box 140 is discharged. The air discharge outlet 141*b* may have a size larger than a size of the air suction inlet 141*a* such that the air smoothly flows and may be defined on a first surface of the barrier 141 and the air suction inlet 141*a* may be defined on a second surface that is bent and extends from the first surface thereof. The first surface may form a rear surface of the control box 140 and the second surface may form a first side surface of the control box 140. The first side surface of the control box 140 may face the inner surface of the case 200 (see FIG. 2). In addition, the air suction inlet 141*a* and the air discharge outlet 141*b* of the barrier 141 may be provided at a portion surrounding an area of the heat sink.

The control box case 142 may be coupled to the barrier 141. The control box case 142 may be made of plastic and be formed by injection, for example. Alternatively, the control box case 142 may be made of metal, for example. The control box case 142 may be coupled to the control box cover 145 to support the main substrate 143 and include a partition 142*a* to divide a rear space of the control box case 142 into a first area and a second area. The first area may be disposed under the second area. A heat sink mounted on the main substrate 143 may be disposed in the first area and elements mounted on the main substrate 143 may be disposed in the second area.

The main substrate 143 may be coupled to the control box cover 145 and support various elements to control the evaporator fan motor 136*c* (see FIG. 5), the condenser fan motor 164 (see FIG. 5), and the compressor 172 (see FIG. 5), and the heat sink 144, and may include a first substrate surface facing the front surface of the air conditioner 100 and a second substrate surface opposite to the first substrate surface to support the elements and the heat sink 144.

The heat sink 144 may be mounted on the main substrate 143 to dissipate heat generated from the elements mounted on the main substrate 143. The heat sink 144 may include a plurality of plates disposed parallel to one another. Each of the plurality of plates may be disposed to be perpendicular to the substrate. The air suction inlet 141*a* may be disposed at a side of the heat sink 144 and the air discharge outlet 141*b* may be disposed at a rear side of the heat sink 144.

The control box cover 145 may cover a surface of the main substrate 143. For example, the control box cover 145 may cover the second substrate surface of the main substrate 142. The main substrate 143 may be coupled to the rear surface of the control box cover 145.

The reactor base 146 may be coupled to the control box cover 145, may be disposed at a front surface of the control box cover 145, and may fix the reactor. The reactor 147 may be coupled to the reactor base 146 and may be disposed on a front surface of the reactor base 146. The reactor cover 148 may be coupled to the reactor base 146 to cover the reactor 147 and may have a hexahedral shape and define an opening at a rear surface thereof.

The second power cover 150 may be coupled to a front surface of the control box cover 145 and the first power cover 149 may be coupled to the second power cover 150. The first power cover 149 and the second power cover 150 may cover a power-supply terminal.

The display cover 151 may be disposed at an upper portion of a front surface of the control box 140 and may be exposed to outside through the interface opening 116 of the front panel 110 (see FIGS. 2 and 3). The display substrate 152 may be coupled to an inner surface of the display cover 151 to support elements for indicating a state of the air conditioner and elements for reviewing input of a user's command or setting information. The user command may include, for example, an operation start command and an operation end command of the air conditioner and the setting information may include, for example, desired temperature information and/or intensity information of discharged air.

The communication module 153 may be mounted on the display substrate 152 or may be coupled to the display cover 151. The communication module 153 may transmit and receive data to and from an external communication device and may be, for example, a wireless fidelity (Wi-Fi) device.

The sub cover 154 may be coupled to the front surface of the control box cover 145 to support and fix the sub-substrate 155. The sub-substrate 155 may be coupled to the sub cover 154 to place elements for supporting functions performed by the elements mounted on the main substrate 143 or performing additional functions in addition to the functions performed by the elements mounted on the main substrate 143. The supporter 156 may be coupled to the front surface of the control box cover 145 to prevent the display cover 151 from sagging downward.

The transformer 157 may be mounted on the main substrate 143 or may be mounted at an additional location, such as the control box cover 145. The transformer 157 may convert an external-input power into a required power.

Figure 8:
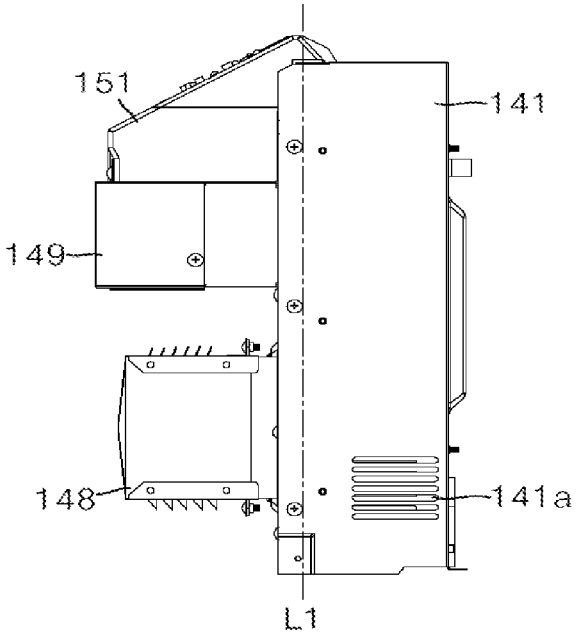
FIG. 8 is a schematic side view of the control box of FIG. 6.

FIG. 8 is a schematic side view of control box 140 of air conditioner 100 according to an embodiment. In FIG. 8, alternated long and short dash line "L1" refers to a position where the main substrate 143 (see FIG. 7) is provided and main body 120 of air conditioner 100 may be divided into an indoor main body and an outdoor main body with respect to the alternated long and short dash line "L1".

That is, according to embodiments disclosed herein, the main body 120 of the air conditioner 100 may include the indoor main body to blow indoor air and the outdoor main body to blow outdoor air. In addition, according to embodiments disclosed herein, the control box 140 may be disposed at a boundary between the outdoor main body and the indoor main body. For example, the main body may be divided into the outdoor main body and the indoor main body with respect to the main substrate 143 (see FIG. 7) of the control box 140. That is, the outdoor air may flow in a space behind the main substrate 143 (see FIG. 7) of the control box 140.

Figure 9:
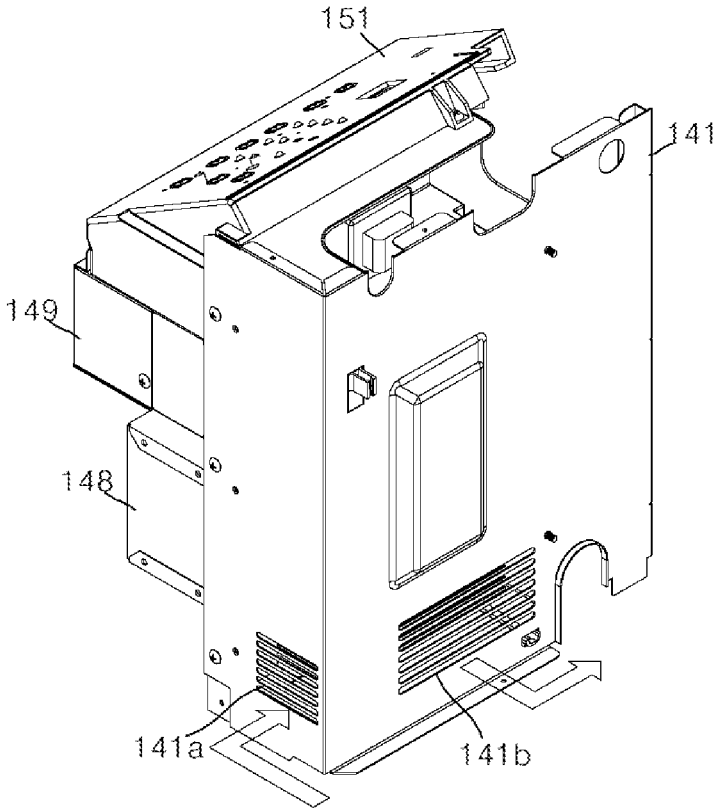
FIGS. 9 to 11 shows air flow at an outdoor portion of an air conditioner.
Figure 10:
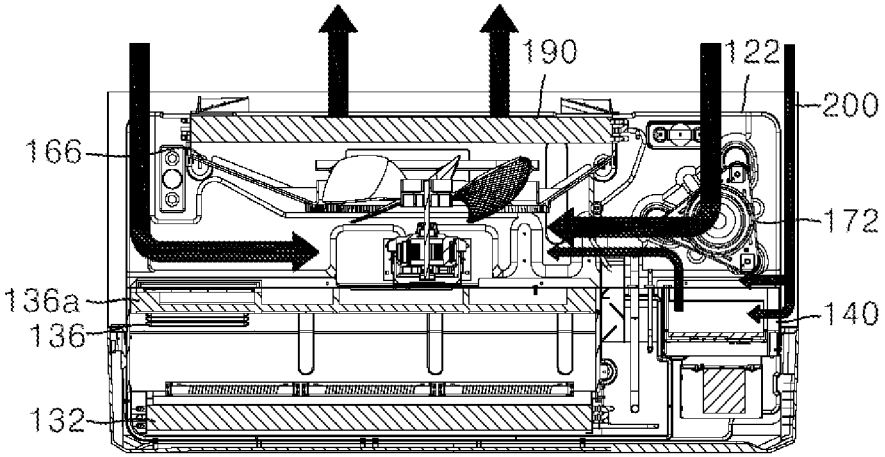
Figure 11:
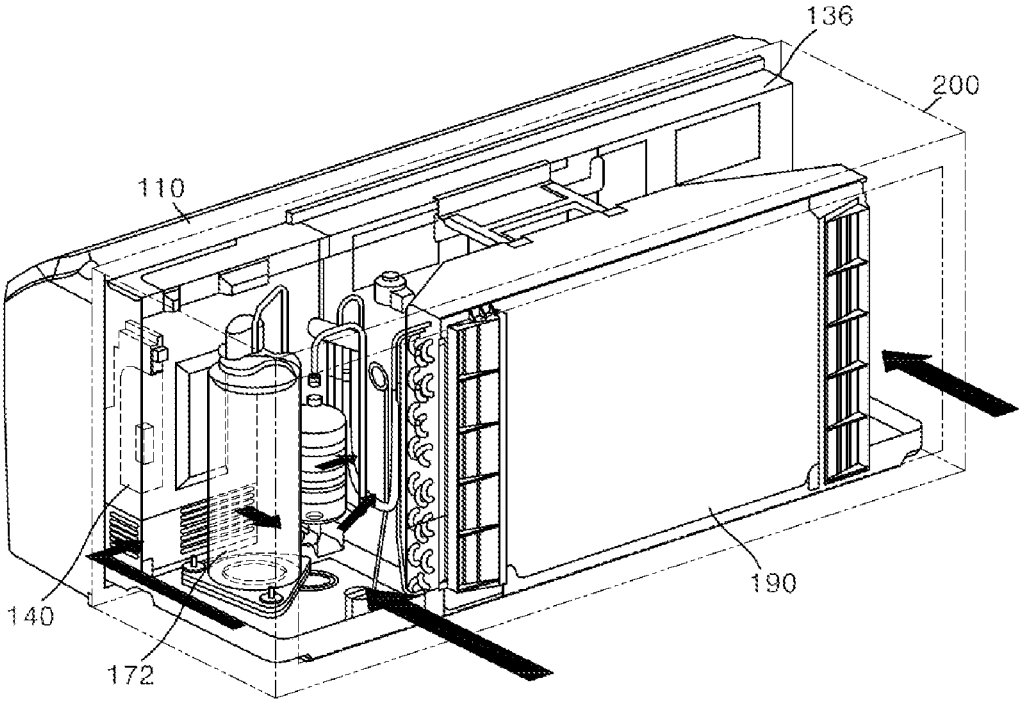

FIGS. 9 to 11 show examples of air flow at an outdoor portion of an air conditioner according to an embodiment. In FIGS. 9 to 11, arrows indicate flow of outdoor air. FIG. 9 is a schematic perspective view of control box 140 of air conditioner 100 viewed from the rear and the side.

The control box 140 may include air suction inlet 141*a* to introduce air into the control box 140 at a first side surface thereof and air discharge outlet 141*b* to discharge air from the control box 140 on a rear surface thereof. In this case, the first side surface of the control box 140 faces the case 200 (see FIG. 2).

FIG. 10 is a cross-sectional view showing an air conditioner taken along line X-X' in FIG. 2. FIG. 11 is a perspective view of air conditioner being inserted into a case, when viewed from the rear and the side.

As shown in FIGS. 4 and 5, the control box 140 of the air conditioner 100 according to embodiments disclosed herein may be disposed on a side surface of the barrier assembly 136. As shown, the rear surface of the control box 140, that is, the barrier 141 (see FIGS. 6 to 9) of the control box 140) may be flush with the rear surface of the barrier assembly 136. Alternatively, in contrast to the drawings, the rear surface of the control box 140 and the rear surface of the barrier assembly 136 may be disposed on different planes.

The main body may be divided into the indoor main body and the outdoor main body with respect to the rear surface 136*a* of the barrier assembly 136. The indoor air may flow based on an operation of the evaporator fan 136*b* in a front portion of the main body with respect to the rear surface 136*a* of the barrier assembly 136. For example, the indoor air may be suctioned through the indoor suction inlet 112 of the front panel 110, pass through the evaporator 132 (see FIG. 5) and/or the heater 134 (see FIG. 5), and be suctioned into the evaporator fan 136*b*. Subsequently, the air may be discharged from the evaporator fan 136*b* and then discharged through the indoor discharge outlet 114 of the front panel 110.

In addition, outdoor air may flow based on an operation of the condenser fan 168 in a rear space of the main body with respect to the rear surface 136*a* of the barrier assembly 136. For example, the outdoor air may be introduced into the case 200 through a space between the condenser 190 and the case 200. Subsequently, the introduced air may pass through the main body, that is, the outdoor main body, of the air conditioner inside of the case 200, and through the shroud opening 166*a* (see FIG. 5) of the shroud 166, and be suctioned to the condenser fan 168 (see FIG. 5). Subsequently, the air may be discharged from the condenser fan 168 (see FIG. 5) and be discharged to outside through the condenser 190.

As the control box 140 is disposed on the side surface of the barrier assembly 136, and the shroud 166 and the condenser fan 168 are disposed behind the barrier assembly 136, an air flow path may be defined behind the control box 140. For example, outdoor air introduced into the space between the case 200 and the condenser 190 may flow into the shroud opening 166*a* through a space between the control box 140 and the compressor 172.

As the air flow path is defined behind the control box 140, pressure of the air discharge outlet 141*b* of the control box 140 may be lower than the pressure inside of the control box 140, and thus, the air inside of the control box 140 may be discharged through the air discharge outlet 141*b*. Further, as the air inside of the control box 140 is discharged, air may be suctioned into the air suction inlet 141*a* defined at the first side surface of the control box 140. For example, the outdoor air introduced into the space between the case 200 and the condenser 190 may pass through the space between the control box 140 and the case 200 and may be introduced into the air suction inlet 141*a*.

According to embodiments disclosed herein, there is provided an air conditioner capable of preventing direct exposure of a control box and/or a heat sink of the control box to rainwater even if it rains. According to embodiments disclosed herein, there is further provided an air conditioner capable of facilitating heat dissipation of control components disposed inside a control box to control an inverter.

The objects are not limited to the above-mentioned objects, and other objects and advantages which are not mentioned may be understood by the description and more clearly understood based on embodiments. It will also be readily understood that the objects and the advantages may be implemented by features defined in claims and a combination thereof.

According to embodiments disclosed herein, the air conditioner may include a control box. The control box may be disposed at a boundary between an indoor main body to blow indoor air and an outdoor main body to blow outdoor air and may introduce the outdoor air to an inside thereof.

The air conditioner may include a barrier assembly including an evaporator fan, an evaporator disposed in front of the barrier assembly, a shroud disposed behind the barrier assembly and defining a shroud opening, a condenser, and a condenser fan disposed between the shroud opening and the condenser. The control box may be disposed on or at a side surface of the barrier assembly.

The control box may have a first side surface spaced apart from the case, defining an air suction inlet configured to suction air on the first side surface thereof and an air discharge outlet configured to discharge the air on a rear surface thereof. Further, the control box may include a main substrate and a heat sink mounted on the main substrate. The air suction inlet and the air discharge outlet may be defined at a portion covering a position area of the heat sink.

The air conditioner may include a base; a barrier assembly disposed on the base and including an evaporator fan configured to introduce air from a front and discharge the introduced air; an evaporator disposed in front of the barrier assembly; a shroud disposed behind the barrier assembly, spaced apart from the barrier assembly, and defining a shroud opening; a condenser disposed behind the shroud; a condenser fan disposed between the shroud opening and the condenser; a compressor connected to the evaporator and the condenser through a pipe; and a control box configured to control the compressor. The control box may be disposed on a side surface of the barrier assembly, have a first side surface spaced apart from the case, define an air suction inlet configured to suction air into the control box on the first side surface thereof and an air discharge outlet configured to discharge the air inside the control box on a rear surface thereof.

The control box may include a main substrate configured to support elements to control the compressor and a heat sink mounted on the main substrate. The heat sink may be disposed in a space between the air suction inlet and the air discharge outlet.

The heat sink may include a plurality of flat plates. Each of the plurality of flat plates may be disposed to be perpendicular to the main substrate.

The control box may include a control box cover disposed on a front surface of the main substrate and coupled to the main substrate; a control box case disposed on a rear surface of the control box cover and coupled to the control box cover; and a barrier disposed on a rear surface of the control box case, coupled to the control box cover, defining the first side surface and the rear surface of an appearance of the control box, and the air suction inlet and the air discharge outlet.

The control box case may include a partition configured to divide a rear space of the control box case into a first area and a second area. The heat sink may be mounted on the main substrate and be disposed in the second area, and the air suction inlet and the air discharge outlet may be each defined in the barrier and surround the second area.

The barrier may include a first surface defining a rear appearance of the control box and the air discharge outlet, and a second surface that is bent and extends from the first surface, defining an appearance of a first side surface of the control box and the air suction inlet.

The control box may further include a reactor base disposed on a front surface of the control box cover and coupled to the control box cover; a reactor disposed on a front surface of the reactor base and coupled to the reactor base; and a reactor cover disposed on a front surface of the control box cover, coupled to the control box cover, and configured to cover the reactor.

The air conditioner may further include a front panel defining a front appearance of the air conditioner, an indoor suction inlet configured to suction indoor air and an indoor discharge outlet configured to discharge the air, which was discharged from the evaporator fan to an indoor space, and in which at least a portion of the control box and the evaporator are each disposed inside of the front panel.

The control box may include a display configured to receive command and setting information from a user and indicate a state of the air conditioner. The display may be exposed to outside through an interface opening defined at the front panel.

The air discharge outlet may have a size larger than a size of the air suction inlet. Further, a distance between the case and the first side surface of the control box may be equal to or greater than 15 mm.

The compressor may be disposed behind the control box. Further, the compressor may be disposed beside the shroud.

A rear surface of the control box may be flush with a rear surface of the barrier assembly.

According to embodiments disclosed herein, even if it rains, the air conditioner may prevent direct exposure of the control box and/or the heat sink inside the control box to rainwater. Further, according to an embodiments disclosed herein, the air conditioner may facilitate heat dissipation of control components disposed in the control box configured to control an inverter.

Although embodiments have been described with reference to drawings hereinabove, the embodiments are not limited to such embodiments and the drawings herein, and various modifications can be made by the skilled person in the art within the scope of the technical idea. Further, even if working effects obtained based on configurations are not explicitly described in the description of embodiments, effects predictable based on the corresponding configuration have to be recognized.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a base;

a case disposed on the base;

a barrier assembly disposed on the base and comprising an evaporator fan configured to introduce air from a front and discharge the introduced air;

an evaporator disposed in front of the barrier assembly;

a shroud disposed behind the barrier assembly, spaced apart from the barrier assembly, and defining a shroud opening;

a condenser disposed behind the shroud;

a condenser fan disposed between the shroud opening and the condenser;

a compressor connected to the evaporator and the condenser through a pipe; and a control box configured to control the compressor, wherein the control box is disposed at a left side surface or at a right side surface of the barrier assembly and comprises:

a control box case;

a control box cover coupled to the control box case;

a main substrate disposed between the control box case and the control box cover;

a heat sink mounted on the main substrate; and a barrier disposed at a rear surface of the control box case, wherein the barrier has a first side surface spaced apart from the case, and defines an air suction inlet through which air is suctioned into the control box on the first side surface thereof and an air discharge outlet through which the air inside the control box is discharged on a rear surface thereof, and wherein the barrier assembly and the control box are disposed at a boundary between an outdoor body and an indoor body.

2. The air conditioner of claim 1, wherein:

the heat sink is disposed in a space between the air suction inlet and the air discharge outlet.

3. The air conditioner of claim 2, wherein the heat sink comprises a plurality of flat plates, and each of the plurality of flat plates extends perpendicular to the main substrate.

4. The air conditioner of claim 1, wherein the barrier is coupled to the control box cover, and defines the first side surface and the rear surface of the control box, and the air suction inlet and the air discharge outlet.

5. The air conditioner of claim 1, wherein the control box case comprises a partition configured to divide a rear space of the control box case into a first area and a second area, where the heat sink is mounted on the main substrate and is disposed in the second area, and wherein the air suction inlet and the air discharge outlet are each defined in the barrier and surround the second area.

6. The air conditioner of claim 1, wherein the barrier comprises:

a first surface defining the rear surface of the control box and the air discharge outlet; and a second surface bent and extended from the first surface, defining the first side surface of the control box and the air suction inlet.

7. The air conditioner of claim 1, wherein the control box further comprises:

a reactor base disposed on a front surface of the control box cover and coupled to the control box cover;

a reactor disposed on a front surface of the reactor base and coupled to the reactor base; and a reactor cover disposed on the front surface of the control box cover, coupled to the control box cover, and configured to cover the reactor.

8. The air conditioner of claim 1, further comprising a front panel defining a front appearance of the air conditioner, an indoor suction inlet through which indoor air is suctioned and an indoor discharge outlet through which the air discharged from the evaporator fan is discharged to an indoor space, and in which at least a portion of the control box and the evaporator are each disposed inside of the front panel.

9. The air conditioner of claim 8, wherein the control box comprises a display configured to receive command and setting information from a user and indicate a state of the air conditioner, and wherein the display is exposed to an outside through an interface opening defined at the front panel.

10. The air conditioner of claim 1, wherein the air discharge outlet has a size larger than a size of the air suction inlet.

11. The air conditioner of claim 1, wherein a distance between the case and the first side surface of the control box is equal to or greater than 15 mm.

12. The air conditioner of claim 1, wherein the compressor is disposed behind the control box.

13. The air conditioner of claim 12, wherein the compressor is disposed adjacent to the shroud.

14. The air conditioner of claim 1, wherein the rear surface of the control box is flush with a rear surface of the barrier assembly.

15. An air conditioner, comprising:

a base;

a case forming an outer appearance of the air conditioner, and disposed on the base;

a barrier assembly disposed on the base and comprising an evaporator fan configured to introduce air into the air conditioner and discharge the introduced air;

an evaporator disposed at a first side of the barrier assembly;

a shroud disposed at a second side of the barrier assembly, spaced apart from the barrier assembly, and defining a shroud opening;

a condenser disposed adjacent to the shroud;

a condenser fan disposed between the shroud opening and the condenser;

a compressor connected to the evaporator and the condenser through a pipe; and a control box configured to control the compressor, wherein the control box is disposed at a third side of the barrier assembly and comprises:

a control box case;

a control box cover coupled to the control box case;

a main substrate disposed between the control box case and the control box cover;

a heat sink mounted on the main substrate; and a barrier disposed at a rear surface of the control box case, the third side being different from the first side and the second side, wherein the barrier has a first side surface spaced apart from the case, defines an air suction inlet through which air is suctioned into the control box on the first side surface thereof and an air discharge outlet through which the air inside the control box is discharged on a rear surface thereof, and comprises a heat sink disposed in a space between the air suction inlet and the air discharge outlet, wherein the third side of the barrier assembly extends in a vertical direction between the first and second sides of the barrier assembly, and wherein the barrier assembly and the control box are disposed at a boundary between an outdoor body and an indoor body.

16. The air conditioner of claim 15, wherein the air discharge outlet has a size larger than a size of the air suction inlet.

17. The air conditioner of claim 15, wherein a distance between the case and the first side surface of the control box is equal to or greater than 15 mm.

18. The air conditioner of claim 15, wherein the compressor is disposed behind the control box.

19. The air conditioner of claim 18, wherein the compressor is disposed adjacent to the shroud.

20. The air conditioner of claim 15, wherein the rear surface of the control box is flush with a rear surface of the barrier assembly.

* * * * *